US007648434B2

(12) United States Patent
Nagao et al.

(10) Patent No.: US 7,648,434 B2
(45) Date of Patent: Jan. 19, 2010

(54) BALL FOR BALL GAME

(75) Inventors: Yukinori Nagao, Hiroshima (JP); Hidesuke Kuriki, Hiroshima (JP)

(73) Assignee: Molten Corporation, Hiroshima-shi, Hiroshima-ken (JP)

( * ) Notice: Subject to any disclaimer, the term of this patent is extended or adjusted under 35 U.S.C. 154(b) by 119 days.

(21) Appl. No.: 11/924,730

(22) Filed: Oct. 26, 2007

(65) Prior Publication Data

US 2008/0051234 A1 Feb. 28, 2008

Related U.S. Application Data

(63) Continuation-in-part of application No. 11/399,380, filed on Apr. 7, 2006, now abandoned.

(51) Int. Cl.
*A63B 41/00* (2006.01)

(52) U.S. Cl. ..... 473/604; 473/605

(58) Field of Classification Search ..... 473/596, 473/597, 603–605, 599, 600–602
See application file for complete search history.

(56) References Cited

U.S. PATENT DOCUMENTS 3,119,618 A 1/1964 Molitor et al.
4,211,407 A * 7/1980 Tomar ..... 473/600
4,364,565 A * 12/1982 Tomar ..... 473/600
4,454,253 A * 6/1984 Murphy et al. ..... 473/569
4,498,667 A * 2/1985 Tomar ..... 473/600
5,181,717 A 1/1993 Donntag et al.
5,636,835 A 6/1997 Schindler et al.
5,931,752 A 8/1999 Guenther et al.
6,022,283 A 2/2000 Schindler et al.
6,024,661 A 2/2000 Guenther et al.
6,544,133 B2 4/2003 Ou
6,645,099 B2 * 11/2003 Gaff et al. ..... 473/596
7,137,915 B2 11/2006 Lin
2006/0293132 A1 * 12/2006 Laliberty et al. ..... 473/603

FOREIGN PATENT DOCUMENTS

JP 51-157253 6/1976

* cited by examiner

*Primary Examiner*—Steven Wong
(74) *Attorney, Agent, or Firm*—Leydig, Voit & Mayer, Ltd.

(57) ABSTRACT

The present invention provides a ball for ball games which has equivalent or increased cushioning properties when compared conventional balls. The ball for ball games of the present invention includes a bladder made of rubber or elastomer, and a foamed layer covering the outside of the bladder, in which a skin layer is provided on each surface sectionalized by partition portions extending from the surface of the foamed layer, the partitions having a lesser degree of expansion than the main portion of the surface which is sectionalized by the portions.

2 Claims, 6 Drawing Sheets

BALL FOR BALL GAME

CROSS-REFERENCE TO RELATED APPLICATION

This is a continuation-in-part of U.S. application Ser. No. 11/399,380 filed on Apr. 7, 2006, now abandoned.

TECHNICAL FIELD

The present invention relates to a ball for a ball game.

BACKGROUND ART

Basketballs have been standardized into an eight-panel outer surface design having raised seams exposed between the edges of exterior skin panels. Basketballs generally consist of a rubber bladder surrounded by a thread-winding layer.

The arrangement of the bladder, thread-winding portion, and a rubber layer are placed in a mold and cured to make the "carcass" of the ball.

During the carcass molding process, raised ridges or seams are molded from the rubber layer. An individual panel section of leather is bonded to the rubber layer in a region between raised seams. After attachment of the panels the ball is completed in a finishing mold.

Basketballs have been made in the above manner. The thread-winding layer around the surface limits expansion of the bladder and assists it in retaining a spherical shape after inflation to a desired pressure. It also prevents the air pressure within the bladder from being fully transferred to the outer covering defined by the panel portions and seams.

The outer covering provides durability and protection. It is common to use synthetic materials to make the panel portions. However, the highest quality balls use top-grain leather.

One ball design developed in the past by the A. G. Spalding Co. ("Spalding design") includes a porous sponge layer positioned between what is characterized as an "inner carcass" and an outer skin. This design is illustrated in U.S. Pat. No. 3,119,618.

The Spading design lacks the rubber layer described above for creating raised seams on the ball described in U.S. Pat. No. 3,119,618.

On the one hand, the invention disclosed in U.S. Pat. No. 5,636,835 is an inflatable, raised scam game ball having a layer of padding underneath the outer covering.

The carcass of the ball is preferably made in the following manner.

Surrounding a spherical rubber bladder by a thread-winding layer;

After the thread-winding layer is wound around the bladder, providing a layer of foamable rubber in a prefoamed condition around the thread-winding layer and covering it completely;

Applying a foaming agent to the foamable rubber;

Positioning narrow strips of seam material (high density black rubber) over the foamable rubber at the locations where it is desired to create raised seams;

Placing this arrangement in a carcass mold where it is cured under temperature in a conventional method;

During the molding process, expanding the foamable layer into a porous sponge rubber layer. At the same time, the seam strips are molded into raised seams;

As a result, when removed from the mold, raised black seams form partially covering the surface of the sponge layer and the sponge rubber layer covering the thread-winding layer.

As with typical leather game balls, the boundaries of the exterior skin panels are defined by the raised seams. Each panel is bonded in a region between seams.

A basketball illustrated in U.S. Pat. No. 5,636,835 has an inner carcass structure, or inner carcass portion, consisting, in combination, of a rubber bladder 12 and a thread-winding layer 14 (see, for example, FIG. 1).

The thread-winding layer 14 surrounds the bladder 12, and the porous sponge 16 surrounds the thread-winding layer 14. A plurality of skin panels 18 and a plurality of seams 20 are bonded to the porous layer 16. Generally, the ball 10 has a total of eight panels separated by seams, which is typical of basketballs.

Each seam 20 is made of a narrow strip of seam material preferably of a high density rubber. A raised central portion 22 of the seam material 20 fills the space between the outer edges 24 and 26 of two adjacent skin panels 28, 30 as well as conventional basketballs.

However, narrow flanges portions 32, 34 of the seam material 20 extend outwardly, in opposite directions, a definite distance from the raised portion 22 which is different from conventional basketballs.

The flange portions 32, 34 underlie the overlapping panel edges 24, 26 and are also sandwiched between the panel edges and underlying sponge layer 16. In other areas, the skin panels 18*a*, 18*b* are bonded directly to the sponge layer 16, as shown by numerals 36, 38. A basketball illustrated in U.S. Pat. No. 3,119,618 has no rubber layer for making a raised seam. However, instead of providing a raised seam, it is well known to provide a protrusion in a sponge layer (for example, Japanese Unexamined Utility Model Publication No. 157253/1976).

Referring to FIGS. 2 and 3, a basketball as illustrated in Japanese Unexamined Utility Model Publication No. 157253/1976 includes a bladder 51 made of butyl rubber, thread-winding layer of nylon thread 52 wound uniformly around the outside of the bladder 51, and vulcanized rubber 53 covering the outside of thread-winding layer 52. The vulcanized rubber 53 includes bubbles, and provides a very soft touch.

The carcass 54 is constructed by the bladder 51, thread-winding layer 52, and vulcanized rubber layer 53. Numeral 55 indicates a partition formed on the carcass 54. The surface of carcass 54 is sectionalized into the shape of a carapace of a turtle with 8 sections, 12 sections, 18 sections, or 32 sections. Numeral 56 indicates a surface sectionalizing and dividing on the surface surrounded by the partition 55. Numeral 57 indicates a spherical surface of the surface 56 in the shape of a sphere sectionalizing and dividing on the surface. Numeral 58 indicates a peripheral portion of surface 56 which is divided to sectionalize the surface with the shape of arc on its cross section. The peripheral portion 58 smoothly bonds to the spherical surface 57. Numeral 59 is a side of a partition, making an acute angle with the peripheral portion 58 described above. Numeral 60 is leather which is attached to the surface 56 which is divided to sectionalize the surface, and thin as compared to conventional leather. The periphery of a back surface of leather 60 is not skived. The cross section of attached leather 60 is directly bonded to the center of side 59 of the partition 55. Thus, when using ball, the cross sectional surface of the attached leather 60 is not peeled from the peripheral edge of leather 60 by catching fingers on the surface of the ball. As leather 60 is thin, it is readily attached. As the peripheral edge portion 58 has a cross section with the shape of a circular arc and is bonded smoothly to the spherical surface 57, unevenness does not occur on the surface of the attached leather 60 and very good handling in use is provided.

A basketball illustrated in Japanese Unexamined Utility Model Publication No. 157253/1976 constructs the peripheral edge 58 of each surface 56 which is divided to sectionalize the surface in the shape of an arc with the smooth seam by a much smaller radius than a radius of the ball on an arbitrary virtual plane which penetrates into the center of the ball. The side face 59 of partition 55 is formed, so that a virtual straight line drawn on the side face 59 of partition 55 penetrates into approximately the center of the ball. The leather 60, which has a uniform thickness without skiving, is applied on the surface 56 which is divided to sectionalize the surface.

DISCLOSURE OF INVENTION

The present invention aims to provide a ball for a ball game which has equal or increased cushioning properties when compared with a ball which has conventional high density rubber seams and differing from a ball having inflatable raised seams with cushion layers under an outer covering, as disclosed in U.S. Pat. No. 5,636,835.

The ball for a ball game of the first and third Embodiments of the present invention comprise:

A bladder made of rubber or elastomer, a foam covering the outside of the bladder, and a skin layer forming the outer surface of the ball, the skin layer being divided into sections by outwardly extending cellular partition portions of the foam layer having a different cellular structure and a lesser degree of expansion than that of the main portion of foam layer from which the partitions extend.

A comparison of the cellular structures of the main portion of the foam layer surrounding the bladder, or in another embodiment of the bladder and the reinforcement layer, is provided in detail in the examples and drawings as follows:

Main Portion (Examples 1 and 2 and FIGS. 5(*a*) and 5(*b*))

| | |
|---|---|
| (a) blending rate | 6.0 phr |
| (b) foaming agent diameter | <15 μm |
| (c) foam cell size | 75-400 μm |
| (d) number of foam cells | 1,000-10,000 cells/cm$^2$ |

Partition Portion

| | |
|---|---|
| (a) blending rate | 3.0-4.0 phr |
| (b) foaming agent diameter | <5 μm |
| (c) foam cell size | 25-100 μm |
| (d) number of foam cells | 100-1,000 cells/cm$^2$ |

A comparison of the data shows that the main portion of the foam layer has an average of about 10 times the number of cells compared with the number of cells in the partition layer and that the cell size of the cells in the main portion is about 2-4 times greater than the cells of the portion layer because of the differences in blending rate and particle size of the foaming agent in the main portion when compared with the amount and particle size of the foaming agent in the partition portions. After vulcanization, the main portion of the foamed layer contains more cells which are of a larger size and the partition portions contain less cells of a smaller size. Thus, the degree of expansion of the foamable main portion is greater than the lesser degree of expansion of the foamable partition portion.

The ball for ball game of the second Embodiment of the present invention comprise:

a bladder made of rubber or elastomer;

a reinforcement layer covering an outside of the bladder; and a foamed layer covering an outside of the reinforcement layer;

wherein a peripheral edge of each surface of the foamed layer is formed in a shape of an arc with a smooth seam, a skin layer is provided on each surface of the foamed layer, and a partition portion of the foamed layer has a lesser degree of expansion than each surface of the main portion which is divided by the partition portions to sectionalize the surface.

The number of cells in the partitions of the foamed layer is also preferably less than the number of cells in each surface of the main portion of the foamed layer which is divided by the partition portions to sectionalize the surface.

It is preferable that the degree of expansion in the partitions of the foamed layer decreases gradually as the partitions extend from each surface of the main portion.

BEST MODE FOR CARRYING OUT THE INVENTION

Referring to attached drawings, a ball for a ballgame (hereinafter referred to as "ball") is explained in detail as the following.

Figure 1:
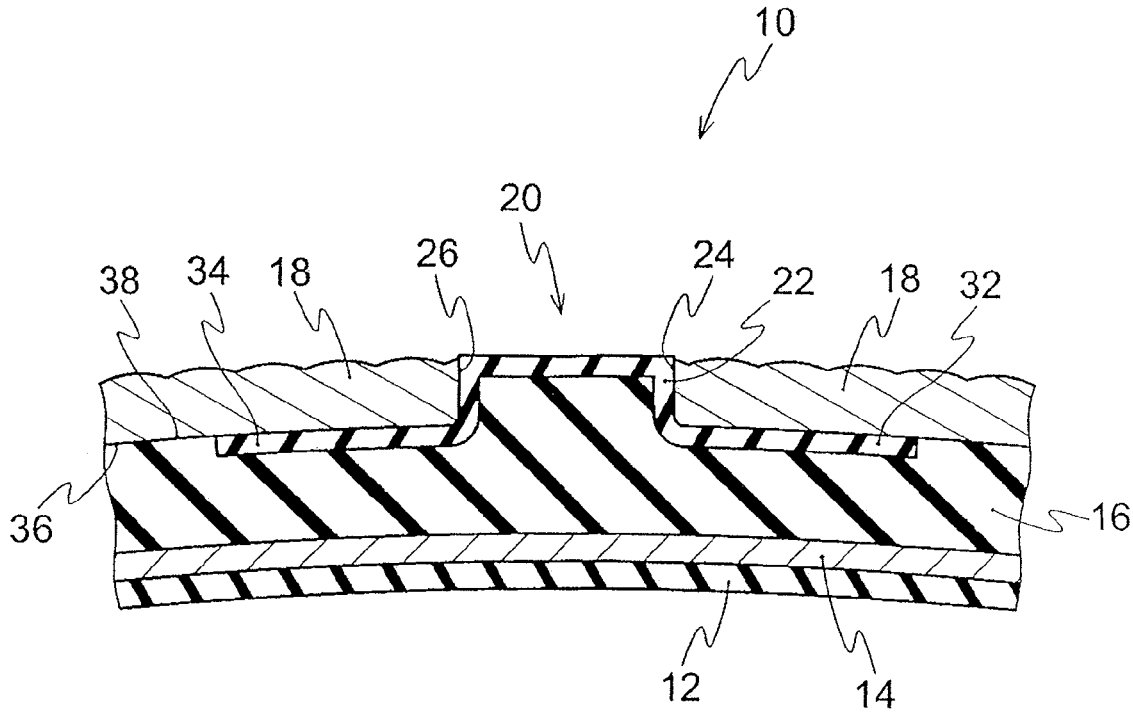
FIG. 1 is a cross sectional explanation view showing one example of a ball according to a conventional art.
Figure 2:
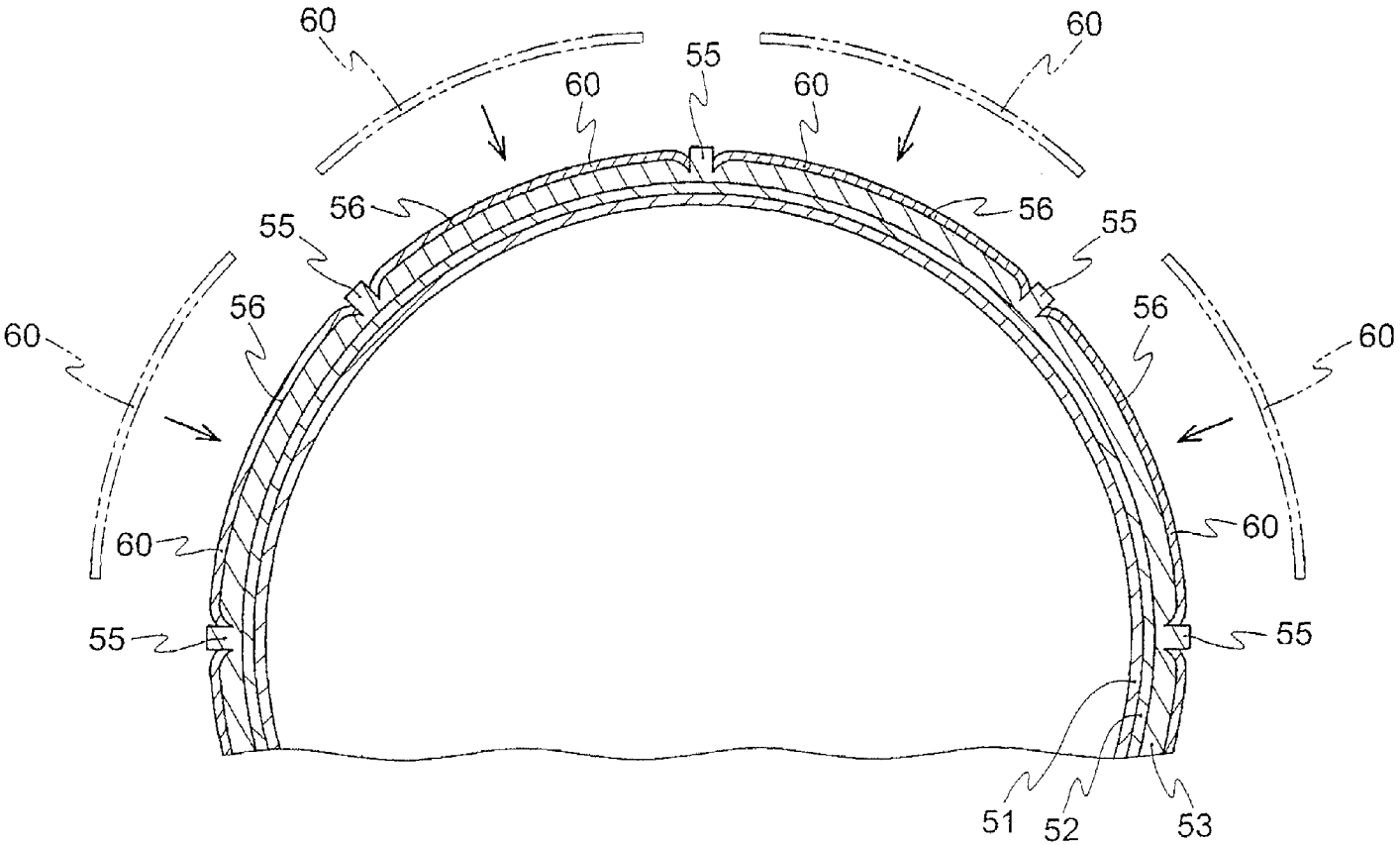
Prior Art FIG. 2
FIG. 2 is a cross sectional explanation view showing another example of a ball according to a conventional art.
Figure 3:
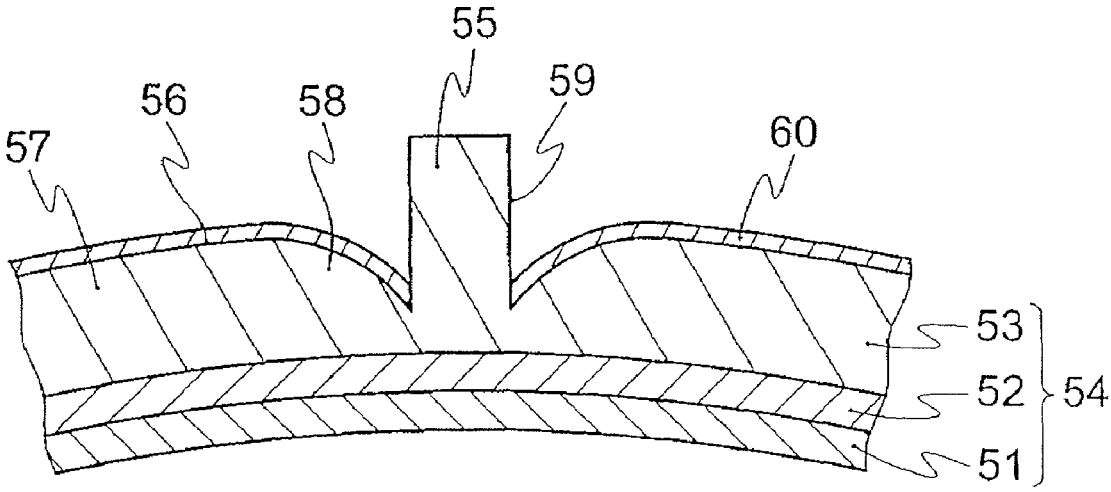
Prior Art FIG. 3
FIG. 3 is an enlarged view of a substantial portion of a ball in FIG. 2.
Figure 4A:
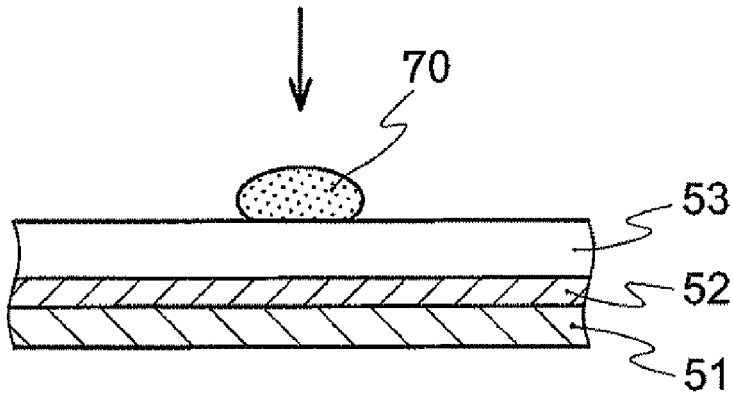
FIGS. 4(*a*) and 4(*b*) are cross sectional explanation views showing processes for manufacturing method of a vulcanized foam rubber layer which is used to construct a ball of the present invention.
Figure 4B:
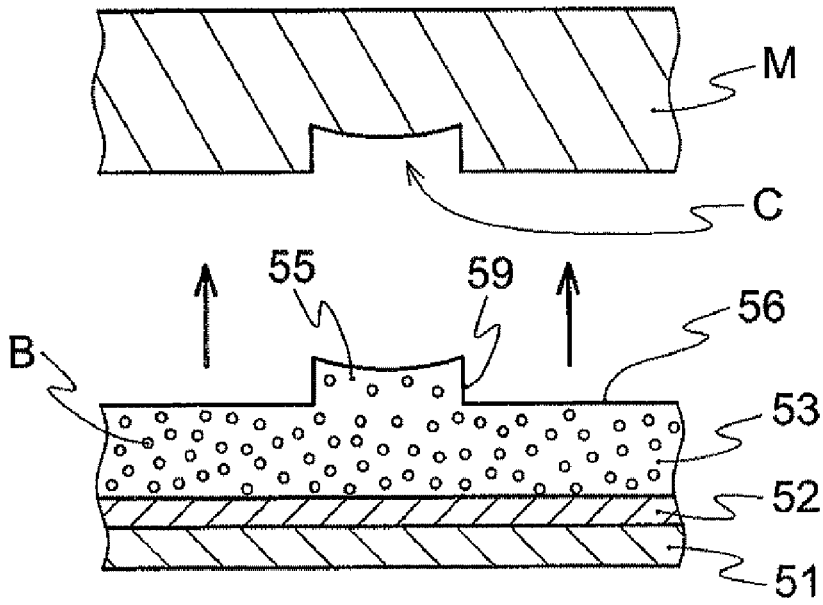
Figure 5A:
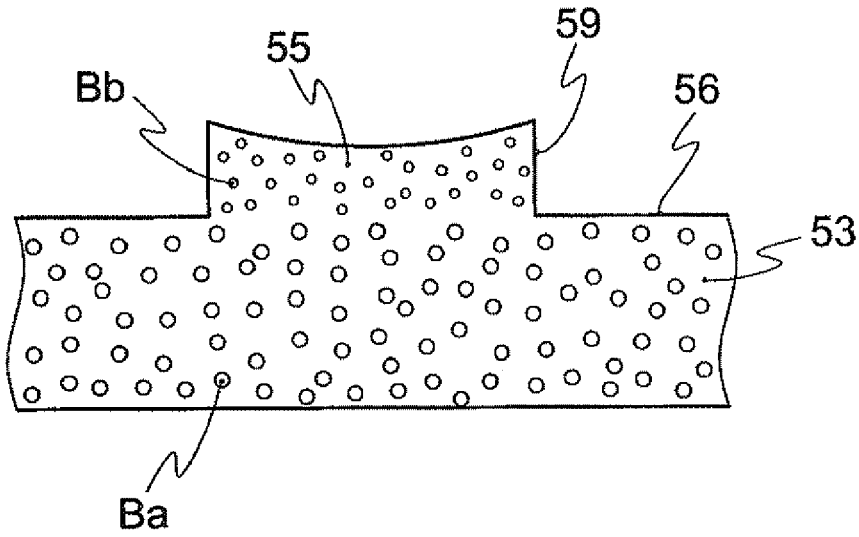
FIGS. 5(*a*) and 5(*b*) are cross sectional explanation views showing a vulcanized rubber layer and a partition which is used to construct a ball of the present invention.
Figure 5B:
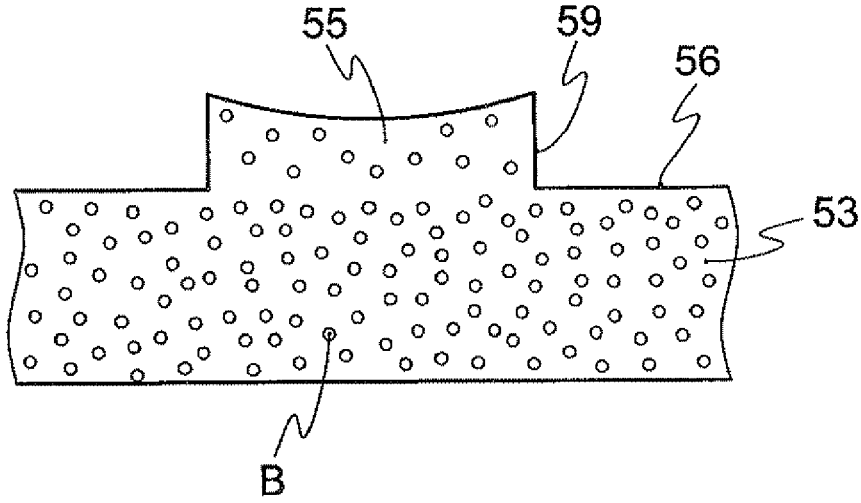
Figure 6:
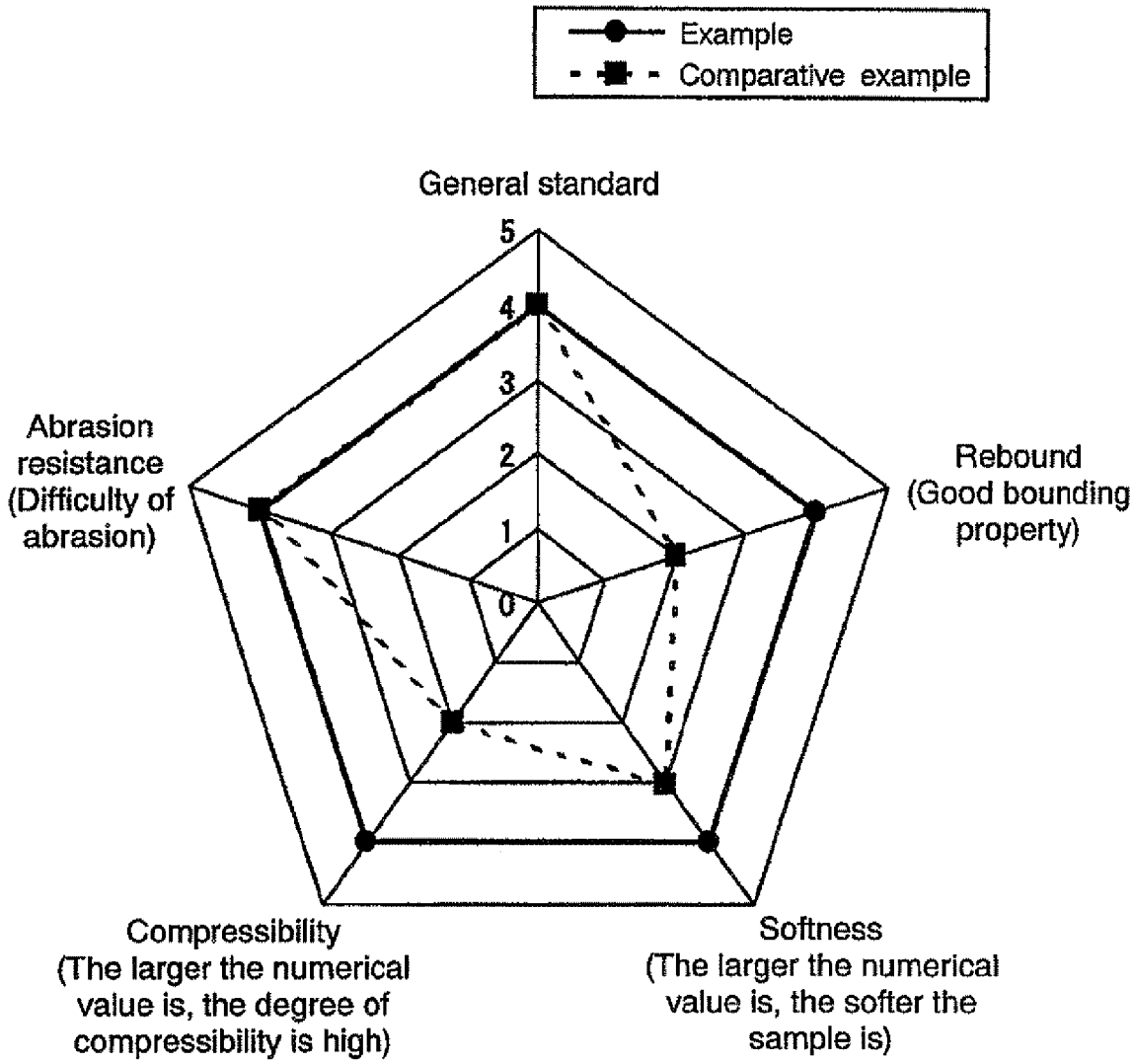
FIG. 6 is a graph showing a comparison of the performance between a ball according to examples of the present invention and a ball of the comparative examples.

FIGS. 4(*a*) and 4(*b*) are cross sectional explanation views showing processes for manufacturing a ball of the present invention, FIGS. 5(*a*) and 5(*b*) are cross sectional explanation views of a vulcanized foam rubber layer which is used to construct a ball of the present invention, FIG. 6 is a graph showing a comparison of the performance between a ball relating to the examples of the present invention and a ball of the comparative examples.

As a ball of the present invention basically has the same construction as a ball illustrated in Japanese Unexamined Utility Model Publication No. 157253/1976, the same constructional portions as Japanese Unexamined Utility Model Publication No. 157253/1976 are explained with the same numerals.

Referring to FIGS. 4(*a*) to 6, a ball of the present Embodiment comprises a bladder 51 made of rubber, a reinforcement layer 52 (thread-winding layer, in which a thread is uniformly wound) provided on the outside of bladder 51, and a vulcanized rubber layer 53 covering the thread-winding layer obtained by vulcanizing unvulcanized foamable rubber. The carcass 54 comprises the bladder 51, a thread-winding layer 52, and vulcanized rubber layer 53. It is well known that a thread-winding layer, cotton cloth and things which are obvious to persons skilled in the art as reinforcement layers of a ball for ball game are included. The bladder 51 described later which has reinforcement function in itself is known to persons skilled in the art. When such a bladder is applied, a reinforcement layer is not necessary.

As a rubber which constructs the bladder 51, rubbers such as butyl rubber, natural rubber, SBR, IR, BR, or EPDM, elastomers such as polyurethane, styrene, chloroethene, olefin, polyester, nitryl, or polyamide can be applied.

As a thread which constructs the thread-winding layer 52, threads made from nylon, polyester, or cotton are applied.

The peripheral edge 58 of each surface 56 of the foamed layer 53 (vulcanized rubber layer) which is divided to sectionalize the surface is formed in the shape of an arc with the smooth seam on a virtual plane which penetrates into the center of a ball of the present Embodiment. The side face 59 of a partition 55 on the foamed layer 53 (vulcanized rubber layer) is formed, so that a virtual straight line on the side face 59 of the partition 55 on the foamed layer 53 (vulcanized rubber layer) approximately penetrates into the center of the ball. A skin layer 60 (for example, natural leather layer or synthetic leather layer) is attached on each surface of vulcanized rubber layer 53 which is divided to sectionalize the surface, but not limited to construction of the partition 55 described above. For example, a surface which slopes relative to the surface 56 which is divided to sectionalize the surface (for example, a skin layer which has a cross sectional trapezium) can be applied. The peripheral edge 58 of each surface 56 of the foamed layer 53 which is divided to sectionalize the surface is not necessarily formed in the shape of arc.

The partition 55 on the foamed layer 53 described above in a ball of the present Embodiment is obtained by vulcanizing the unvulcanized foam rubber which has a lesser degree of expansion than the unvulcanized rubber on which it is superposed on comprising the main portion. However, the method of making the partition 55 is not limited to such method. There is a mold M which is provided with a cavity C. For example, in a cavity C, a small amount of foamed unvulcanized rubber having a lower degree of expansion is embedded in a mold M, and a main foamable body covering the thread wound around the bladder 51 is placed adjacent the skin layer. This assembly is placed into a mold (not shown) to be vulcanized. However, this method is not limited to such a method. The partition 55 can be also obtained by vulcanizing either unvulcanized partition 55 or unvulcanized surface 53 which is divided to sectionalize the surface. The partition 55 can be also obtained by joining with an adhesive agent even if both the partition 55 and the main portion surface 53 which is divided by the partitions to sectionalize the surface are vulcanized. It is well known that methods for joining which are obvious to persons skilled in the art can be also applied.

Referring to FIGS. 4(*a*) and 4(*b*), a method for producing the bladder 51, thread-winding layer 52, and vulcanized foamable rubber layer 53 used to construct a ball of the present Embodiment is explained.

The bladder 51, thread-winding layer 52, and unvulcanized rubber layer 53 are formed.

After the unvulcanized foamable rubber 70, which has a lesser degree of expansion than the unvulcanized foamable rubber layer 53, is superposed on the unvulcanized rubber layer 53, the layer is placed in the mold M to heat and pressurize only for a predetermined time period (10 to 15 minutes) (at the temperature of 40 to 170° C., pressure 0 to 8 kgf/cm$^2$).

The partition 55 on vulcanized rubber layer 53 can be obtained by opening mold M.

There is a tendency that when the particle diameter of the foaming agent blended into the rubber is reduced, the foamed cell becomes fine in size, and when the particle diameter of the foaming agent blended into the rubber is increased, the foamed cell becomes larger in size.

When the amount of foaming agents blended into rubber is increased, the number of foamed cells increases, and when the amount of foaming agents blended into rubber is increased, the number of foamed cells decreases. There is also a tendency that as the amount of foaming agents in vulcanized rubber layer 53 and that of partition 55 are equalized, the number of cells gradually decreases.

EMBODIMENT 1

When the blending rate of a foaming agent in the unvulcanized rubber layer 53 of the main portion (portions except for the partition 55) is 6.0 phr, the blending rate of the foaming agent in the partition 55 is 4.0 phr, a particle diameter of the foaming agent in the main portion is under 20 μm, and the particle diameter of the foaming agent in the partition 55 is under 10 μm, a foamed cell Ba with a size of 100 to 400 μm is obtained in the main portion, and a foamed cell Bb with a size of 50 to 100 μm is obtained in the partition 55 as shown in FIG. 5(*a*).

When the amount of foaming agent is 4 to 6 phr, the partition 55 will include a large number of foamed cells Bb as shown in FIG. 5(*a*). A particle diameter of foaming agent is preferably under 10 μm to obtain a reduced size of foamed cells.

EMBODIMENT 2

When the blending rate of the foaming agent in the unvulcanized rubber layer 53 of the main portion (portions except for the partition 55) is 6.0 phr, the blending rate of the foaming agent in the partition 55 is 3.0 phr (i.e. the amount of the foaming agent is 1 to 4 phr in the partition 55), after vulcanization to a foamed state, in which the number of the foamed cells in the partitions 55 (100 to 1000 pieces/cm$^2$) is lesser than that of the foamed cells in the main portion (1000 to 10000 pieces/cm$^2$) occurs as shown in FIG. 5(*b*). A diameter of a foamed cell in FIG. 5(*b*) is 100 to 400 pm.

A ball in the present invention is explained in detail with examples, but the present invention is not limited to the example

EMBODIMENT 3

When the blending rate of a foaming agent in the unvulcanized rubber layer 53 of the main portion (portions except for the partition 55) is 6.0 phr, the blending rate of the foaming agent in the partition 55 is 4.0 phr, a particle diameter of the foaming agent in the main portion is under 15 μm, and a particle diameter of the foaming agent in the partition 55 is under 5 μm, a foamed cell Ba with a size of 75 to 400 μm is obtained in a main portion, and a foamed cell Bb with a size of 25 to 100 μm is obtained in the partition 55 as shown in FIG. 5(*a*).

EXAMPLE

The blending rate of the rubber composition in each rubber, one is rubber used in the vulcanized rubber layer 53 which is used to construct a ball according to the example, the other is the rubber used in the partition 55 as shown in Table 3.

On the one hand, a ball related to U.S. Pat. No. 5,636,835 described above was used as a comparative example.

General standard, rebound, touch (softness), compressibility (hardness) and abrasion resistance were experimentally determined. (refer to Table 1, Table 2 FIG. 6)

TABLE 1

| Items to be estimated | Example | Comparative Example |
|---|---|---|
| Materials of skin layer | Natural leather | Artificial leather: polyurethane |
| Rebound | Free Fall of 1.8 m under internal pressure of 0.7 kgf/cm$^2$<br>129 cm | Free fall of 1.8 m under internal pressure of 0.7 kgf/cm2<br>122 cm<br>The sample was reluctant to bound as compared to example |
| Touch (Softness) | Impact value of dropping the sample from the point where a distance between the point and the floor was 1 m under internal pressure of 0.7 kgf/cm$^2$<br>91.35 kgf | Impact value of dropping the sample from the point where a distance between the point and the floor was 1 m under internal pressure of 0.7 kgf/cm2<br>92.94 kgf<br>The sample was hard as compared to example |
| Compressibility (hardness) | Compression energy in the case where the sample was compressed by means of a jig having a diameter of 10 mm with a compression of 5 kgf<br>45.31 gf/cm | Compression energy in the case where the sample was compressed by means of a jig having a diameter of 10 mm with a compression of 5 kgf<br>37.94 gf/cm<br>The sample was hard as compared to example |
| Abrasion resistance | Shooting test: 4000 times (comparison of abrasion in a rib)<br>Internal pressure under 0.7 kgf/cm$^2$-compression rate 81%<br>About rib: a crack was not generated | Shooting test: 4000 times (comparison of abrasion In a rib)<br>Internal pressure under 0.7 kgf/cm$^2$-compression rate 81%<br>About rib: a crack was not generated |

TABLE 2

| | | | | |
|---|---|---|---|---|
| Rebound at 20° C. | Example<br>Comparative Example | Free fall of 1.8 m under internal pressure of 0.7 kgf/cm$^2$ | The larger the numerical value is, the better the sample bound (cm) | 129<br>122 |
| Touch | Example<br>Comparative Example | Impact test at normal temperature<br>Free fall of 1 m under internal pressure of 0.7 kgf/cm$^2$ | The smaller the numerical value is, the softer the sample is (kg o | 91.35<br>92.94 |
| | Example<br>Comparative Example | Compression test with hands<br>Compressibility of being compressed under internal pressure of 0.7 kgf/cm$^2$ | The larger the numerical value is, the softer the sample is | 37.94<br>45.31 |

TABLE 3

| | Blending rate | |
|---|---|---|
| | Main Portion | Partition |
| Natural rubber | 100.0 | 100.0 |
| Calcium carbonate | 25.0 | 25.0 |
| Silica | 10.0 | 10.0 |
| Factice (trade mark) | 5.0 | 5.0 |
| Carbon black | 7.0 | 7.0 |
| Processing acid | 3.5 | 3.5 |
| Sulfur | 2.4 | 2.4 |
| Zinc oxide | 5.0 | 5.0 |
| Stearic acid | 1.0 | 1.0 |
| Accelerator | 2.3 | 2.3 |
| Foaming agent | 6.0 | 3.0 |
| Sum | 167.2 | 164.2 |

It proves that as a result, a ball in the example and a ball in comparative example are equivalent to a general standard and abrasion resistance as shown in FIG. 6, but the ball in the example is superior to a ball in the comparative example in rebound, touch (softness), and compressibility (hardness).

INDUSTRIAL APPLICABILITY

According to the present invention, a ball for ball game can be provided which has equal or increased cushioning properties when compared to a ball which has conventional high density seams and which is different from a ball having inflatable raised seams with cushion layers under an outer covering.

The invention claimed is:

1. A ball for a ball game comprising a bladder made of rubber or elastomer and a foamed layer covering an outer surface of the bladder, wherein an outer surface of the foamed layer is divided by linear partitions, the outer surface of the foamed layer comprises the partitions and sectionalized surfaces, comprising a remainder of the outer surface of the foamed layer, the partitions are raised relative to the sectionalized surfaces adjacent to the partitions, a tip of the raised partition is in contact with outer air, a skin layer is provided on the sectionalized surfaces, the foam layer comprises vulcanized rubber and foamed cells, the foamed layer further comprises: a raised portion A of a first spherical surface, which includes the tip of the raised partition and is concentric to the ball for a ball game, and a second spherical surface, which includes a peripheral portion of the sectionalized surfaces adjacent to the partitions and is concentric to the ball for a ball game; and a portion B of the foamed layer, which comprises a remainder of the foamed layer, a number of foamed cells in the portion A is 100-1,000 per cm$^2$, and the number of foamed cells in the foamed layer gradually decreases as a distance from beneath the partition, toward the portion A, increases, a diameter of foamed cells in the portion B is 75-400 micrometers, and a number of foamed cells in the portion B is 1,000-10,000 per $cm^2$.

2. The ball for a ball game according to claim 1, further comprising a reinforcement layer between the outer surface of the bladder and the foamed layer, and peripheries of the sectionalized surfaces of the foamed layer have a shape of an arc with smooth bonds.

* * * * *